US009147985B1

(12) United States Patent
Noriega

(10) Patent No.: US 9,147,985 B1
(45) Date of Patent: Sep. 29, 2015

(54) EXPANDABLE AND ROTATABLE POWER STRIP

(71) Applicant: Aimet Noriega, Hialeah, FL (US)

(72) Inventor: Aimet Noriega, Hialeah, FL (US)

(73) Assignee: Creative Technologies Investment, Inc., Miami, FL (US)

( * ) Notice: Subject to any disclaimer, the term of this patent is extended or adjusted under 35 U.S.C. 154(b) by 0 days.

(21) Appl. No.: 14/220,196

(22) Filed: Mar. 20, 2014

(51) Int. Cl.
*H01R 35/04* (2006.01)
*H01R 25/00* (2006.01)
*H01R 35/02* (2006.01)

(52) U.S. Cl.
CPC ..... *H01R 25/003* (2013.01); *H01R 35/025* (2013.01)

(58) Field of Classification Search
CPC .... H01R 25/004; H01R 35/04; H01R 25/006; H01R 13/514; H01R 31/06; H01R 2103/00
See application file for complete search history.

(56) References Cited

U.S. PATENT DOCUMENTS 5,658,158 A * 8/1997 Milan ..... 439/214
6,045,399 A 4/2000 Yu
7,229,302 B1 6/2007 Lai
7,607,928 B2 10/2009 Schriefer et al.
7,625,242 B2 12/2009 Axland et al.
7,824,185 B2 * 11/2010 Chien ..... 439/11
7,874,856 B1 * 1/2011 Schriefer et al. ..... 439/214
8,262,399 B1 * 9/2012 Zien et al. ..... 439/188
8,702,447 B2 * 4/2014 Lau ..... 439/535
2011/0207351 A1 8/2011 Hsiao
2012/0028505 A1 2/2012 Weber et al.
2013/0023147 A1 1/2013 Zien et al.
2013/0102194 A1 4/2013 Long et al.
2014/0102870 A1 * 4/2014 Zien et al. ..... 200/51 R

* cited by examiner

*Primary Examiner* — Gary Paumen
(74) *Attorney, Agent, or Firm* — Dale J. Ream

(57) ABSTRACT

An expandable and rotatable power strip includes a power cord having configured to deliver electrical current to a distal end. A plurality of primary socket modules is electrically connected to the power cord and to one another, each of the plurality of socket modules having a housing with a socket outlet configured to receive a power plug and to deliver current thereto. Each primary socket module includes a male conduction assembly electrically connected to and extending from a first side of the housing and a female conduction assembly electrically connected to and extending from a second side thereof. A respective male conduction assembly of one primary socket module is rotatably coupled to a respective female conduction assembly of an adjacent primary, the respective male conduction assembly and the respective female conduction assembly configured to transmit current therebetween. The distance between adjacent socket modules is length adjustable.

15 Claims, 5 Drawing Sheets

EXPANDABLE AND ROTATABLE POWER STRIP

BACKGROUND OF THE INVENTION

This invention relates generally to electrical outlet devices and, more particularly, to a power strip that is length adjustable and in which individual socket modules may be rotatably articulated relative to adjacent socket modules.

Power strips having multiple socket outlets have long been used to enable multiple electric devices to be plugged in where there is an insufficient number of wall electrical receptacles to plug into. Traditional power strips include a generally long and rectangular housing with a short power cord. For instance, a power strip is useful beneath a computer desk so that the power cords of a computer, monitor, printer, modem, lamp, and the like may be plugged in and then powered using only a single wall receptacle.

While this configuration may be effective when a multitude of electrically powered devices are located in close proximity and can all plugged into the power strip, the traditional power strip is not as effective when the electric devices are displaced from one another or have relatively short power cords themselves. Further, the traditional power strip often does not fit into crowded spaces or around obstacles. For instance, multiple extension cords must be used to join more than one power strip to reach a wall receptacle, such as in a bedroom where alarm clocks, lamps, and stereos on night stands on either side of the bed have only a single wall receptacle for use.

Therefore, it would be desirable to have a power strip having multiple individual socket modules that are length adjustable such that the power strip can be elongated to accommodate electric devices that are spaced apart. Further, it would be desirable to have a power strip having multiple individual socket modules that can be rotatably articulated around obstacles or to fit in crowded spaces.

SUMMARY OF THE INVENTION

An expandable and rotatable power strip according to the present invention includes a power cord having configured to deliver electrical current to a distal end. A plurality of primary socket modules is electrically connected to the power cord and to one another, each of the plurality of socket modules having a housing defining an interior area and having a socket outlet configured to receive a power plug and to deliver current thereto. Each primary socket module includes a male conduction assembly electrically connected to and extending from a first side of the socket module housing and a female conduction assembly electrically connected to and extending from a second side of the socket module housing. A respective male conduction assembly of one primary socket module is rotatably coupled to a respective female conduction assembly of an adjacent primary, the respective male conduction assembly and the respective female conduction assembly configured to transmit current therebetween.

Therefore, a general object of this invention is to provide an expandable and rotatable power strip having multiple individual socket modules to receive multiple electric plugs and which is length adjustable and rotatable.

Another object of this invention is to provide an expandable and rotatable power strip, as aforesaid, that in one configuration couples adjacent socket modules in a rigid and linear configuration and in another configuration couples adjacent socket modules in a rotatable configuration.

Still another object of this invention is to provide an expandable and rotatable power strip, as aforesaid, in one configuration decreases a distance between adjacent socket modules and in another configuration increases a distance between adjacent socket modules.

Yet another object of this invention is to provide an expandable and rotatable power strip, as aforesaid, in which adjacent socket modules may be rotatably articulated only when in the lengthened configuration.

A further object of this invention is to provide an expandable and rotatable power strip, as aforesaid, in which individual primary socket modules may be added or removed from the power strip.

A still further object of this invention is to provide an expandable and rotatable power strip, as aforesaid, in which electrical current is transferred between adjacent socket modules at any configuration so as to power electrical devices plugged into respective socket modules.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
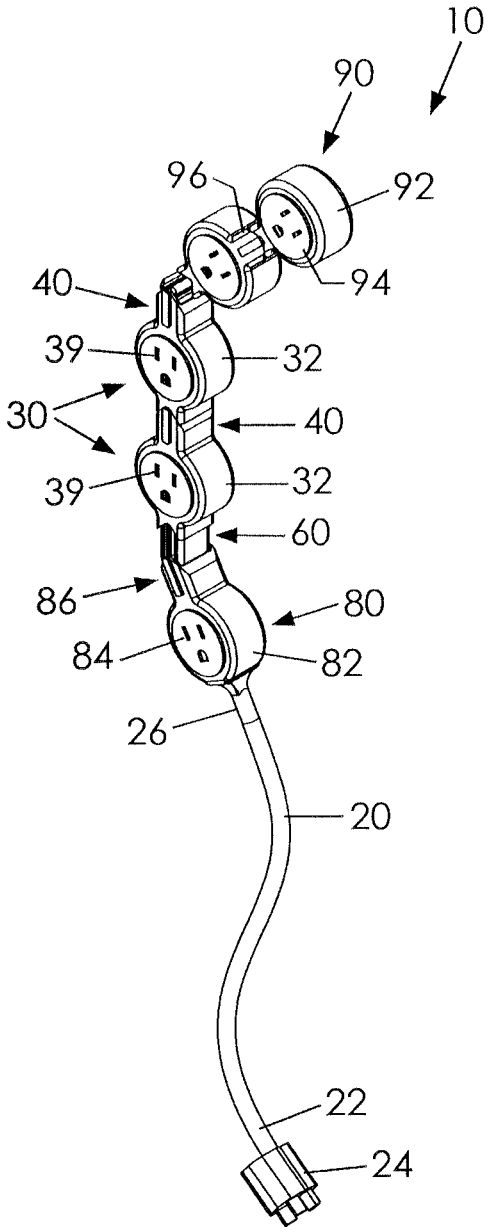
FIG. 1 is a perspective view of an expandable and rotatable power strip according to a preferred embodiment of the present invention.

A length expandable and rotatable power strip according to a preferred embodiment of the present invention will now be described in detail with reference to FIGS. 1 to 4*b* of the accompanying drawings. The length expandable and rotatable power strip 10 includes a power cord 20 and a plurality of primary socket modules 30.

The power cord 20 includes a proximal end 22 terminating in a plug 24 that is configured to connect to a standard electrical power outlet, such as a wall receptacle. The cord 20 includes standard conductors configured to deliver electrical current to a distal end 26 that is opposite the proximal end 22. The power cord 20 will supply electrical current to the other components of the power strip as described below.

The power strip 10 includes a plurality of primary socket modules 30 as well as a first socket module 80 and a last socket module 90 which will be described below. All of the socket modules are electrically connected to the distal end 26 of the power cord 20 as well as to each other in electrical sequence. The specific means for each electrical connection will be described with regard to corresponding structures below.

Figure 3A:
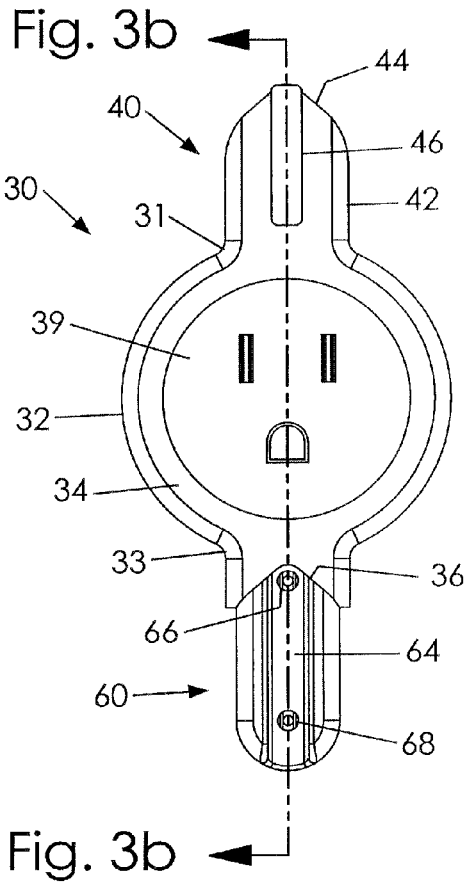
FIG. 3*a* is a top view of the primary socket module as in FIG. 2*a;*
Figure 3B:
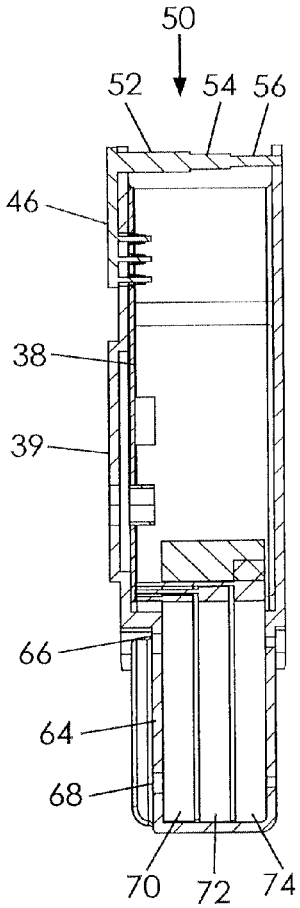
FIG. 3*b* is a sectional view taken along line 3*b*-3*b* of FIG. 3*a;*

Each primary socket module 30 includes a socket module housing 32 defining an interior area (FIG. 3*b*). A circuit board 38 or equivalent circuitry is situated in the interior area. The socket module housing 32 includes a socket outlet 39 electrically connected to the circuit board 38 and is configured to receive a power plug—such as from an electrical device such as a lamp, personal electronics item, or the like—and is configured to deliver current.

Each primary socket module 30 includes a male conduction assembly 40 and a female conduction assembly 60 situated opposite from one another. More particularly, the male conduction assembly 40 is electrically connected to the circuit board 38 in the socket module housing 32 and extends away from a first side 31 of the socket module housing 32. The female conduction assembly 60 is also electrically connected to the circuit board 38 in the socket module housing 32 and extends away from a second side 33 thereof. As will be described further, a respective male conduction assembly 40 of one primary socket module 30 is rotatably coupled to a respectively to a respective female conduction assembly 60 of an adjacent primary socket module. It is understood that respective male and female conduction assemblies are constructed of appropriate conductive materials or include wires or solder paths so as to transmit electrical current to one another when contacted. Further, it is understood that the components of the male conduction assembly 40, the female conduction assembly housing 62, the socket module housing 32, and the like include insulation and may include imbedded structures for transmitting electrical current so as not to provide a shock hazard to a consumer.

Figure 2A:
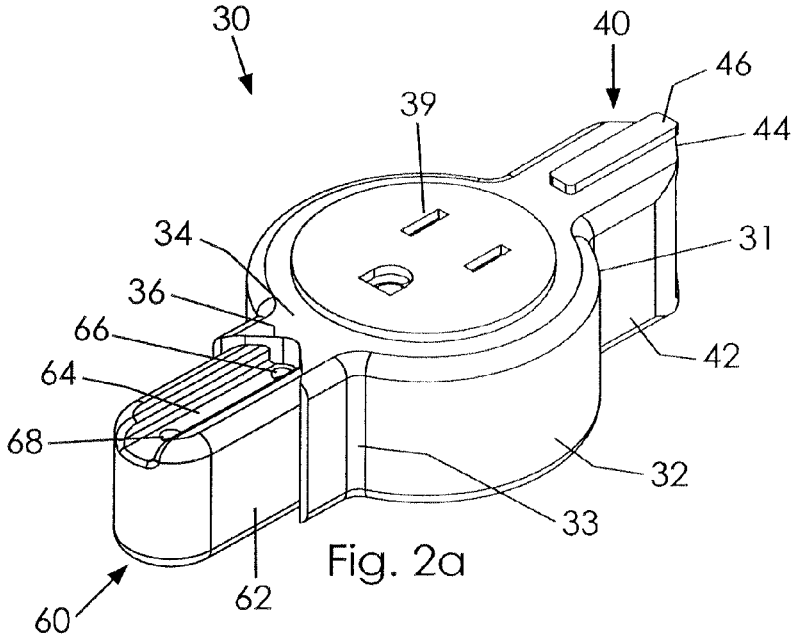
FIG. 2*a* is a perspective view of a primary socket module of the power strip as in FIG. 1.
Figure 2B:
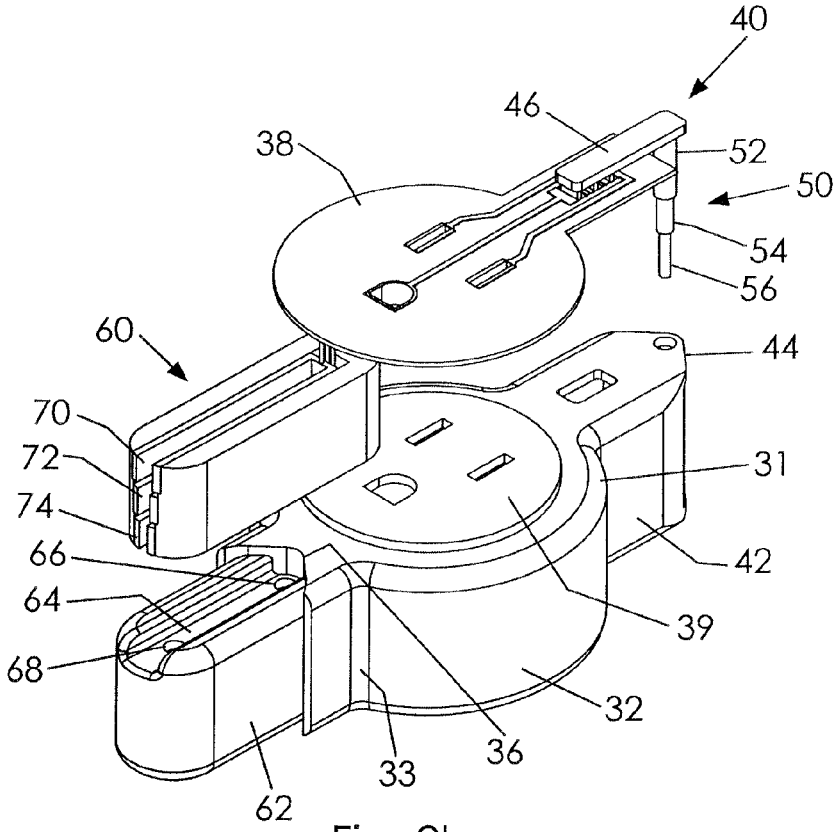
FIG. 2*b* is an exploded view of the primary socket module as in FIG. 2*a;*

Each male conduction assembly 40 includes an upper connector 46 that is electrically connected to the circuit board 38 and a current transfer plug 50 electrically connected to a distal end of the upper connector 46 and extends downwardly therefrom (FIG. 2*b*). Preferably, the current transfer plug 50 includes a general cylindrical configuration defining a vertical axis about which the female conduction assembly 60 of an adjacent primary socket module 30 may rotate as will be described later. In addition, the current transfer plug 50 includes three segments: an upper portion 52, intermediate portion 54, and lower portion 56. It is understood that these portions correspond to carry positive, negative, and neutral parts of current from the circuit board.

The female conduction assembly 60 includes a female conduction assembly housing 42 having an upper wall 64 and defines an interior space. The upper wall 64 defines an inner bore 66 therethrough that is in communication with the interior space. Similarly, the upper wall 64 defines an outer bore 68 that is spaced apart from the inner bore 66 and is in communication with the interior space. The outer bore 68 is adjacent an outer edge of the female conduction assembly housing 42 whereas the inner bore 66 is adjacent the second end 33 of the socket module housing 32 (FIGS. 2*a* and 2*b*). Each bore is configured to receive a respective current transfer plug 50 from an adjacent primary socket module 30.

A plurality of electrical conductors is positioned within the interior space of the female conduction assembly housing 42. More particularly, the electrical conductors include an upper conductor 70, an intermediate conductor 72, and a lower conductor 74, all of which are electrically connected to the respective circuit board 38 of the primary socket module 30. The conductors are positioned on inner side walls of the housing and are positioned to contact the corresponding portions 52, 54, 56 of a respective current transfer plug 50 that has been received into the interior space so as to transfer current.

The current transfer plug 50 of the male conduction assembly 40 of one primary socket module 30 may be selectively inserted into either the outer bore 68 or the inner bore 66 of a respective female conduction assembly of a next adjacent primary socket module 30. The choice of mating the current transfer plug 50 with either the inner bore 66 or outer bore 68 will affect both rotation and length expansion of the power strip 10 as will be described in more detail later.

A primary socket module 30 is releasably coupled to an adjacent primary socket module 30. More particularly, a current transfer plug 50 of a male conduction assembly 40 is slidably removable from the inner bore 66 or outer bore 68 of a female conduction assembly 60 of an adjacent primary socket module 30. In use, an entire primary socket module 30 may be removed from the power strip 10 and the remaining primary socket modules 30 reattached as described above. Similarly, an additional primary socket module 30 may be inserted between existing primary socket modules 30 by first releasing a pair of adjacent modules and then connecting respective male and female conduction assemblies of the additional module.

Figure 4A:
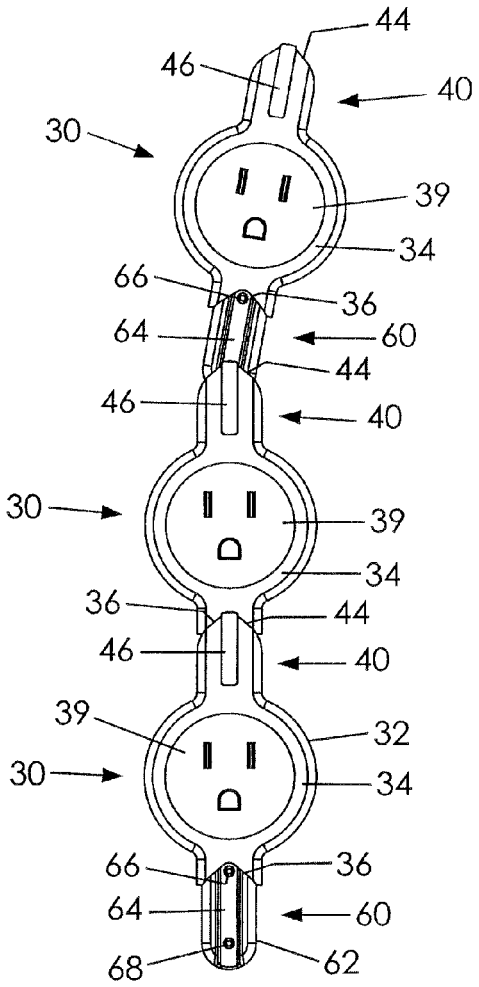
FIG. 4*a* is a top view of a portion of the power strip as in FIG. 1 illustrated in one articulated configuration.
Figure 4B:
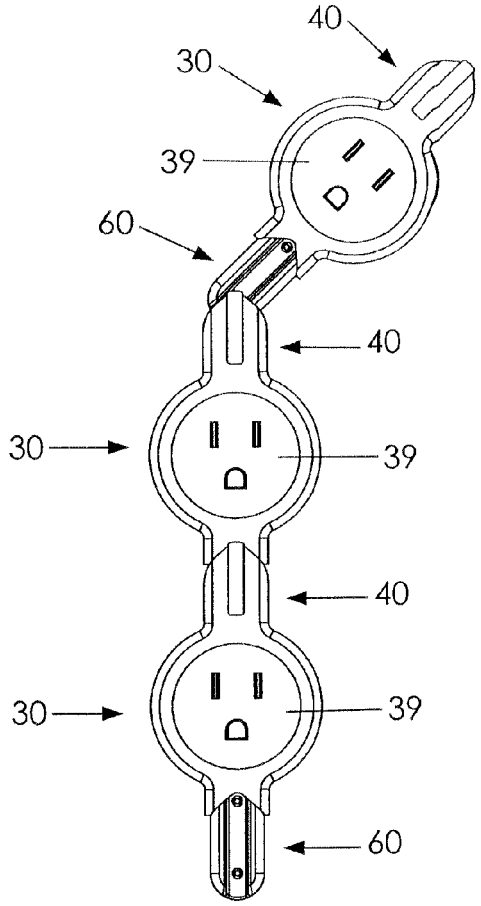
FIG. 4*b* is another top view of a portion of the power strip as in FIG. 1 illustrated in another articulated configuration.

The length of the power strip 10 is increased or decreased according to which of the inner bore 66 or outer bore 68 of a female conduction assembly 60 is utilized. In other words, a distance between adjacent primary socket modules is one distance when the current transfer plug 50 of one primary socket module is inserted into an outer bore 68 of the female conduction assembly of an adjacent primary socket module and is another distance (i.e. a shorter distance) when the current transfer plug 50 of one primary socket module is inserted into an inner bore 66 of the female conduction assembly 60 of an adjacent primary socket module. Examples of both configurations are shown in FIGS. 4*a* and 4*b*.

Figure 5A:
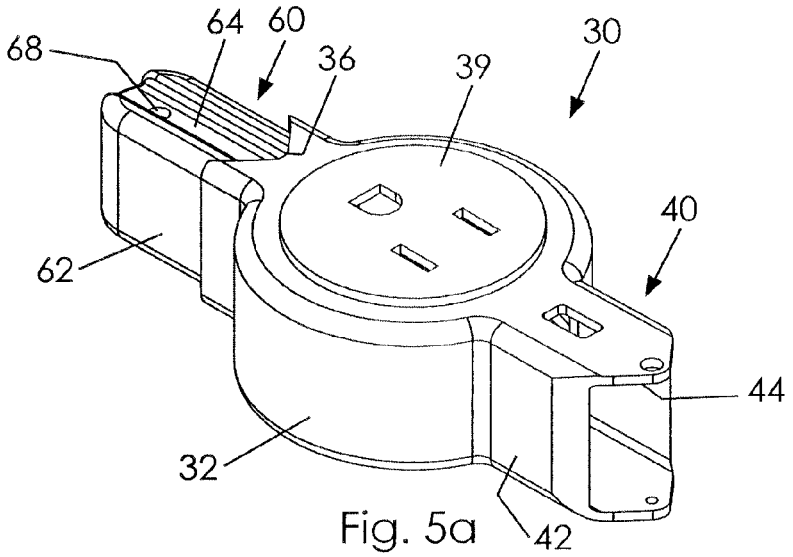
FIG. 5*a* is a perspective view of the power strip from another angle as in FIG. 2*a*.
Figure 5B:
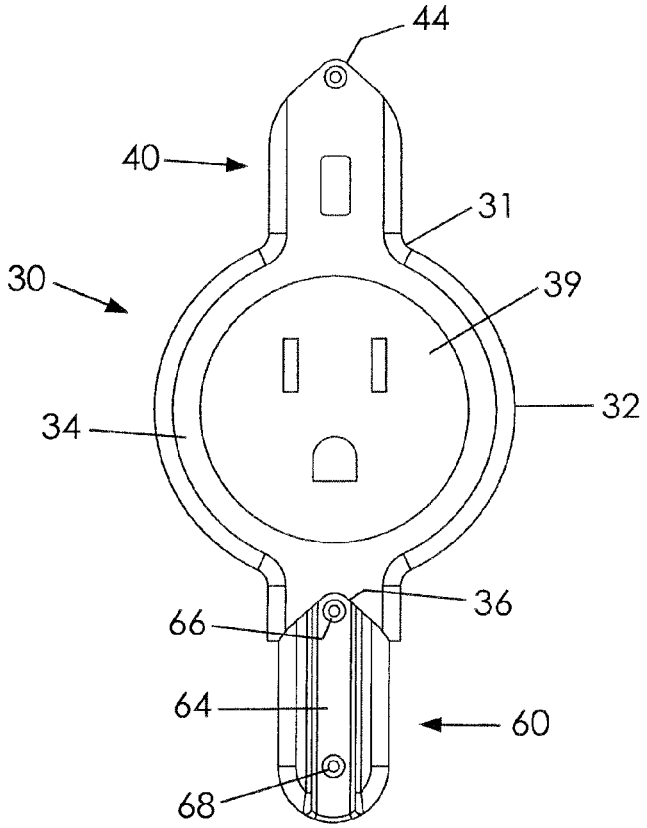
FIG. 5*b* is a top view of the power strip as in FIG. 4*a*.

The male conduction assembly 40 of a primary socket module 30 includes a male conduction assembly housing 42 having opposed side walls that define an open front and an open interior (FIG. 5*a*). This structure is significant in that when a current transfer plug 50 is to be inserted into an inner bore 66 of an adjacent primary socket module 30, the female conduction assembly housing 42 of the adjacent primary socket module 30 is received through the open front into the open interior of the primary socket module 30. It is understood, then, that the size of a female conduction assembly housing 42 is correspondingly smaller so as to be received into the open interior of an adjacent male conduction assembly.

One primary socket module is rotatable about a vertical axis defined by a respective outer bore 68 of an adjacent primary socket module when a current transfer plug 50 is inserted into the outer bore 68 of a female conduction assembly 60. However, a primary socket module 30 is not rotatable when a current transfer plug 50 is inserted into the inner bore 66 of a female conduction assembly 60. Rotation is prevented due to a notch and pointed end construction described below.

The socket module housing 32 of a primary socket module 30 includes a top wall 34 that defines a notch 36 adjacent the second side 33 of the housing (FIG. 3*a*). In addition, a respective male conduction assembly 40 includes an outer end 44 displaced from the first side 31 of a respective socket module housing 32 that is configured to selectively nest within a respective notch 36 of an adjacent socket module housing 32. In use, when a current transfer plug 50 is received into an inner bore 66 of an adjacent primary socket module 30, the outer end 44 and notch 36 nest together so as to prevent rotation of the adjacent primary socket modules relative to one another. Examples of this nested configuration are shown in FIGS. 4*a* and 4*b*. Therefore, adjacent primary socket modules are rigidly coupled together in a linear configuration when a respective pointed outer end 44 and notch 36 are nested or mated together.

The expandable and rotatable power strip 10 includes a "first" socket module 80 and a "last" socket module 90 each having a slightly different construction than the plurality of primary socket modules 30. The first socket module 80 is electrically connected to the distal end 26 of the power cord 20. The first socket module 80 includes a first socket module housing 82 defining an interior area and includes a circuit board and socket outlet 84 electronically connected to the circuit board and configured to receive a power plug to deliver current thereto. The first socket module 80 includes a first male conduction assembly 86 having a construction as described previously and that extends from a downstream side of the first socket module housing 82. The first male conduction assembly 86 may be selectively coupled to a female conduction assembly 60 as described previously.

Similarly, the last socket module 90 is electrically connected to an adjacent primary socket module 30 and includes a last socket module housing 92 defining an interior area and includes a circuit board and socket outlet 94 electronically connected to the circuit board and configured to receive a power plug and to deliver current thereto. The last socket module 90 includes a last female conduction assembly 96 having a construction substantially as described previously and extending from a upstream side of the last socket module housing 92. The last female conduction assembly 96 of a last socket module 90 may be coupled to a male conduction assembly 40 of an adjacent primary socket module as described previously.

In use, the expandable and rotatable power strip 10 may be configured to fit a desired application and need. For instance, it may be desirable to position the power strip 10 in a corner, amidst the legs of furniture, or anywhere that a traditional linear power strip would not be received conveniently. Accordingly, individual primary socket modules 30 may be rotatably coupled together in customized configurations. More particularly, two adjacent socket modules may be rotatably coupled together by mating a male conduction assembly 40 of one socket module with an outer bore 68 of a female conduction assembly 60 of an adjacent socket module as described above. This allows the adjacent modules to be rotatably articulated in other than a linear configuration. By contrast, other adjacent socket modules may be locked into a linear arrangement by mating a male conduction assembly 40 of one socket module with an inner bore 66 of a female conduction assembly 60 of an adjacent socket module as described above. Rotatable articulation is only possible when the outer bore 68 is utilized due to the housing notch 36 adjacent the inner bore 66 as described above.

In addition, the expandable and rotatable power strip 10 may be expanded in length with similar manipulations of male and female conduction assemblies. For instance, the power strip 10 may be moved to a retracted or shortened configuration by mating some or all of the male conduction assemblies to respective inner bores 66 of respective female conduction assemblies. By contrast, the power strip 10 may be positioned at an extended or lengthened configuration by mating some or all of the male conduction assemblies to respective outer bores 68 of respective female conduction assemblies. This configuration increases the distance between adjacent socket modules. Rotatable articulation between adjacent socket modules is also possible at the extended configurations.

Accordingly, the expandable and rotatable power strip 10 provides enhanced flexibility to businesses and consumers who desire to have a power strip that can be selectively shortened or lengthened and that can be rotatably articulated around obstacles.

It is understood that while certain forms of this invention have been illustrated and described, it is not limited thereto except insofar as such limitations are included in the following claims and allowable functional equivalents thereof.

The invention claimed is:

1. An expandable and rotatable power strip, comprising:

a power cord having a proximal end terminating in a plug configured to connect to an electrical power receptacle, said power cord being configured to deliver electrical current to a distal end opposite said proximal end;

a plurality of primary socket modules electrically connected to said distal end of said power cord and to one another in sequence, each of said plurality of primary socket modules including a socket module housing defining an interior area and having a circuit board and a socket outlet positioned in said interior area and configured to receive a power plug and to deliver current thereto;

wherein each primary socket module includes a male conduction assembly electrically connected to and extending from a first side of said socket module housing and a female conduction assembly electrically connected to and extending from a second side of said socket module housing;

wherein a respective male conduction assembly of one primary socket module is rotatably coupled to a respective female conduction assembly of an adjacent primary socket module, said respective male conduction assembly and said respective female conduction assembly being configured to transmit current therebetween.

2. The expandable and rotatable power strip as in claim 1, wherein:

said male conduction assembly includes an upper connector electrically connected to said circuit board and a current transfer plug electrically connected to a distal end of said upper connector and extending downwardly therefrom;

said female conduction assembly includes a female conduction assembly housing having an upper wall and defines an open interior space;

said upper wall defines an inner bore generally adjacent said second side of said socket module housing and in communication with said interior space;

said upper wall defines an outer bore spaced apart away from said inner bore and in communication with said interior space; and a plurality of conductors situated in said interior space and positioned to electrically contact a respective current transfer plug when received in said interior space.

3. The expandable and rotatable power strip as in claim 2, wherein each of said inner bore and said outer bore of a respective female conduction member of a respective primary socket module is configured to selectively receive a respective current transfer plug of a respective male conduction assembly of another primary socket module into said interior space.

4. The expandable and rotatable power strip as in claim 3, wherein said plurality of conductors of a respective female conduction assembly is electrically coupled to a respective circuit board in a respective primary socket module.

5. The expandable and rotatable power strip as in claim 2, wherein a respective current transfer plug of a respective male conduction assembly is selectively positioned in one of a respective inner bore or a respective outer bore of a respective female conduction assembly so as to vary a distance between adjacent primary socket modules.

6. The expandable and rotatable power strip as in claim 2, wherein:

said plurality of conductors includes an upper conductor, an intermediate conductor, and a lower conductor;

said current transfer plug includes an upper portion, an intermediate portion, and a lower portion; and said upper, intermediate, and lower conductors are positioned to electrically contact corresponding upper, intermediate, and lower portions of said current transfer plug, respectively, so as to transfer electrical current between a corresponding male conduction assembly and a corresponding female conduction assembly.

7. The expandable and rotatable power strip as in claim 1, wherein said one primary socket module is selectively releasable from said adjacent primary socket module.

8. The expandable and rotatable power strip as in claim 1, wherein said respective male conduction assembly of said one primary socket module is selectively releasable from said respective female conduction assembly of said adjacent primary socket module.

9. The expandable and rotatable power strip as in claim 8, wherein said primary housing is insulated to prevent electric shock.

10. The expandable and rotatable power strip as in claim 1, comprising:

a first socket module electrically connected to said distal end of said power cord and having a first socket module housing defining an interior area, said first socket module having a circuit board situated in said interior area and having a socket outlet electrically connected said circuit board and configured to receive a power plug and to deliver current thereto; and wherein said first socket module includes a first male conduction assembly electrically connected to and extending from a downstream side of said first socket module housing, said first male conduction assembly being selectively coupled to a respective female conduction assembly of a respective primary socket module.

11. The expandable and rotatable power strip as in claim 10, comprising:

a last socket module electrically connected to a respective main support member and having a last socket module housing defining an interior area, said last socket module having a circuit board situated in said interior area and having a socket outlet electrically connected said circuit board and configured to receive a power plug and to deliver current thereto; and wherein last socket module includes a last female conduction assembly electrically connected to and extending from an upstream side of said last socket module housing, said last female conduction assembly being selectively coupled to a respective male conduction assembly of a respective primary socket module.

12. The expandable and rotatable power strip as in claim 1, comprising:

a last socket module electrically connected to a respective main support member and having a last socket module housing defining an interior area, said last socket module having a circuit board situated in said interior area and having a socket outlet electrically connected said circuit board and configured to receive a power plug and to deliver current thereto; and wherein last socket module includes a last female conduction assembly electrically connected to and extending from an upstream side of said last socket module housing, said last female conduction assembly being selectively coupled to a respective male conduction assembly of a respective primary socket module.

13. The expandable and rotatable power strip as in claim 1, wherein:

said socket module housing includes a top wall that defines a notch adjacent said second side thereof;

said male conduction assembly includes an outer end displaced from said first side of said socket module housing; and said outer end of a respective male conduction assembly is configured to selectively nest with a respective notch of an adjacent socket module housing.

14. The expandable and rotatable power strip as in claim 13, wherein said one primary socket module is rigidly coupled to a respective female conduction assembly of said adjacent primary when said outer end of a respective male conduction assembly is nested with a respective notch of said adjacent socket module housing.

15. The expandable and rotatable power strip as in claim 2, wherein:

said male conduction assembly includes a male conduction assembly housing having a pair of side walls defining an open front and an open interior; and said female conduction assembly housing is selectively received through said open front into said open interior of a respective male conduction assembly when a respective current transfer plug is received into a respective inner bore of a respective female conduction assembly.

* * * * *